US007150539B2

(12) United States Patent
Chen et al.

(10) Patent No.: US 7,150,539 B2
(45) Date of Patent: Dec. 19, 2006

(54) ILLUMINATED PATTERN DEVICE

(75) Inventors: Ga-Lane Chen, Fremont, CA (US); Tsung-Wei Chiang, Tu-chen (TW); Chun-Yu Lee, Tu-chen (TW); Ming Chiang Tsai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 87 days.

(21) Appl. No.: 10/893,610

(22) Filed: Jul. 16, 2004

(65) Prior Publication Data

US 2005/0024869 A1 Feb. 3, 2005

(30) Foreign Application Priority Data

Jul. 16, 2003 (TW) ..... 92119355 A

(51) Int. Cl.
*F21V 1/00* (2006.01)
*G09F 13/04* (2006.01)

(52) U.S. Cl. ..... 362/235; 362/351; 362/812; 40/564

(58) Field of Classification Search ..... 362/235, 362/241, 247, 812, 351; 40/564, 550, 551, 40/574, 575, 577
See application file for complete search history.

(56) References Cited

U.S. PATENT DOCUMENTS 1,779,732 A * 10/1930 Gorsse ..... 40/575
1,986,732 A * 1/1935 Lane ..... 362/240
3,631,619 A * 1/1972 Campbell ..... 40/564
4,967,317 A * 10/1990 Plumly ..... 362/613
5,249,104 A * 9/1993 Mizobe ..... 362/605
5,299,109 A * 3/1994 Grondal ..... 362/241
5,946,837 A * 9/1999 Ackers ..... 40/558
6,167,648 B1 * 1/2001 Dimmick ..... 40/564
6,174,075 B1 1/2001 Fuwausa
6,193,392 B1 * 2/2001 Lodhie ..... 362/235
6,509,840 B1 * 1/2003 Martineau ..... 340/815.45
6,595,671 B1 * 7/2003 Lefebvre et al. ..... 362/247
6,966,684 B1 * 11/2005 Sommers et al. ..... 362/604
2002/0181232 A1 * 12/2002 Martineau ..... 362/246

* cited by examiner

*Primary Examiner*—Alan Cariaso
(74) *Attorney, Agent, or Firm*—Wei Te Chung

(57) ABSTRACT

An illuminated pattern device includes a pattern body (32) having a pattern (321), a bottom board (39) having a reflective surface, a plurality of dot light sources arranged on the bottom board, and a frame (36) sandwiched between the pattern body and the bottom board. The pattern defines a projection surface on the bottom board. The dot light sources are evenly arranged on the bottom board such that they provide relatively uniform brightness for the pattern body.

17 Claims, 3 Drawing Sheets

ILLUMINATED PATTERN DEVICE

BACKGROUND OF THE INVENTION

1. Field of the Invention

The present invention relates to pattern devices used for displaying images such as for advertising, and particularly to an electrically illuminated pattern device.

2. Description of Prior Art

A conventional pattern device, such as a registration mark of a billboard or a vehicle, cannot illuminate by itself. If the image of the pattern device is to be clearly seen at night, it must be illuminated by an external source. However, external illumination has various inherent limitations, including the angle of illumination, the brightness of the source, and the reflective ratio of the pattern device. These limitations frequently result in the pattern device being unevenly illuminated. Furthermore, the brightness and overall display of the pattern device may be unsatisfactory.

Generally, to solve the above-described problems, an active light source is arranged at the back of the pattern device. A pattern device having an active light source arranged at the back thereof is known as an illuminated pattern device.

A conventional illuminated pattern device is represented in FIGS. 6 and 7. The illuminated pattern device 1 includes a pattern body 12, a frame 16 arranged around a periphery of the pattern body 12, and a dot light source 101 arranged at the back of the pattern body 12. The pattern body 12 is elliptical, and includes a pattern 121, a top surface 17, a cavity 18 and a bottom surface 19. The pattern 121 defines a projection surface (not labeled) on the bottom surface 19. The cavity 18 is defined between the top surface 17 and the bottom surface 19. The dot light source 101 is a light emitting diode (LED), and is secured in the cavity 18. In particular, the dot light source 101 is arranged at a center of the projection surface defined on the bottom surface 19.

Because the dot light source 101 is arranged at a center of the projection surface, the distribution of the light energy from the dot light source 101 is uneven. For example, a central circular area 100 on the pattern body 12 receives much more light energy from the dot light source 101 than other portions of the pattern body 12. Accordingly, a brightness of the pattern 121 is not uniform. The result is that the overall pattern 121 cannot be clearly seen at night.

SUMMARY OF THE INVENTION

An object of the present invention is to provide an illuminated pattern device which has reasonably uniform light brightness.

In order to achieve the object set forth, an illuminated pattern device of the present invention includes a pattern body having a pattern, a bottom board having a reflective surface, a plurality of dot light sources arranged on the bottom board, and a frame sandwiched between the pattern body and the bottom board. The pattern defines a projection surface on the bottom board. The dot light sources are evenly arranged on the bottom board, such that they provide relatively uniform brightness for the pattern body.

In a first embodiment of the present invention, the illuminated pattern device is elliptical, and comprises two dot light sources located on an elliptical bottom board at points corresponding to elliptical focuses of the bottom board. The sum of the distances from any one point on an elliptical periphery of the projection surface to the dot light sources is the same as the sum of the distances from any other point on said periphery to the dot light sources. That is, all points along said periphery receive the same total amount of light energy from the dot light sources. Accordingly, all points along an elliptical periphery of the pattern body receive the same total amount of direct light energy from the dot light sources. Similarly, other non-peripheral points on the pattern body that share a same imaginary elliptical trace receive the same total amount of direct light energy from the dot light sources. In addition, some light is reflected by internal reflective surfaces of the illuminated pattern device once or more before it reaches the pattern body. This further enhances uniform distribution of light energy to the pattern body. Thus a brightness of the pattern body can be relatively uniform.

Other objects, advantages and novel features of the invention will become more apparent from the following detailed description when taken in conjunction with the accompanying drawings.

DETAILED DESCRIPTION OF THE INVENTION

Figure 1:
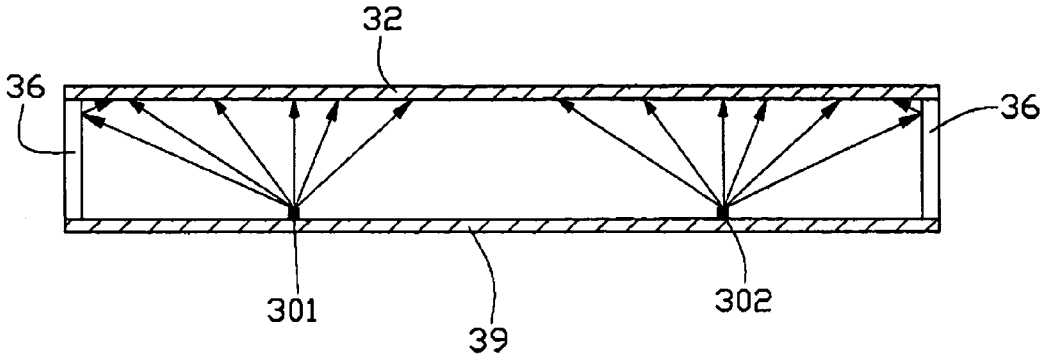
FIG. 1 is a schematic, cross-sectional view of an illuminated pattern device according to a first embodiment of the present invention.
Figure 2:
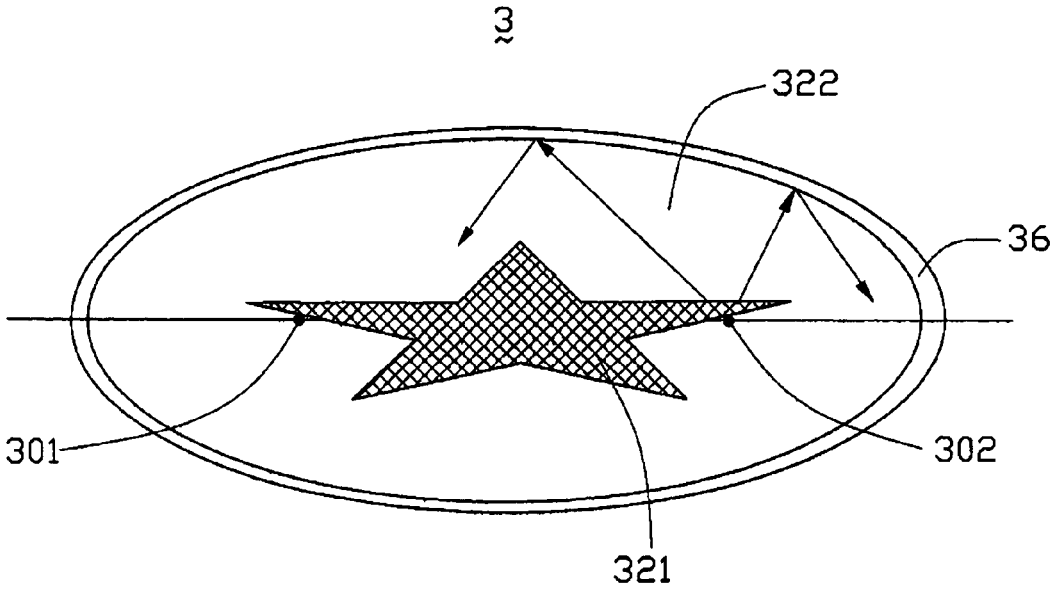
FIG. 2 is a schematic, isometric view of the illuminated pattern device of FIG. 1, showing light paths thereof.

Referring to FIGS. 1 and 2, an illuminated pattern device 3 in accordance with the first embodiment of the present invention includes a pattern body 32, a bottom board 39, and a frame 36 sandwiched between the pattern body 32 and the bottom board 39. The bottom board 39 has two dot light sources 301, 302 arranged thereon. Inner sides of the frame 36 and bottom board 39 have reflective surfaces. The pattern body 32 is elliptical, and includes a pattern 321 and an unpatterned portion 322. The pattern 321 is made of transparent material. The unpatterned portion 322 is opaque or translucent. If the unpatterned portion 322 is opaque, its inner sides have reflective surfaces. A cavity is defined between the pattern 321 and the bottom board 39. Alterna tively, the cavity is filled with transparent material. The pattern 321 of the pattern body 32 defines a projection surface (not labeled) on the bottom board 39. The bottom board 39 and its projection surface are both elliptical. The light sources 301, 302 are arranged at two focal points that define the ellipse of the projection surface. The light sources 301, 302 are LEDs.

Because the light sources 301, 302 are arranged at the focal points of the projection surface, the sum of the distances from any one point on a periphery of projection surface to the two focal points is the same as the sum of the distance from any other point on said periphery of projection surface to the two focal points. That is, all points along said periphery receive the same total amount of light energy from the light sources 301, 302. Accordingly, all points along an elliptical periphery of the pattern body 32 receive the same total amount of direct light energy from the light sources 301, 302. Similarly, other non-peripheral points on the pattern body 32 that share a same imaginary elliptical trace receive the same total amount of direct light energy from the light sources 301, 302. In addition, some light is reflected by the reflective surfaces once or more before it reaches the pattern body 32. This further enhances uniform distribution of light energy to the pattern body 32. Thus a brightness of the pattern body 32 can be relatively uniform. Even at night, the pattern body 32 can be clearly viewed.

The illuminated pattern device 3 may be used for applications such as in a billboard, as a logo displayed on a vehicle, and so on. For example, if the illuminated pattern device 3 is used as a logo displayed on a vehicle, an electrical input terminal (not shown) of the illuminated pattern device 3 can be connected with the output terminal of a battery of the vehicle. That is, the energy needed by the illuminated pattern device 3 can be supplied by the general power supply of the vehicle itself.

Figure 3:
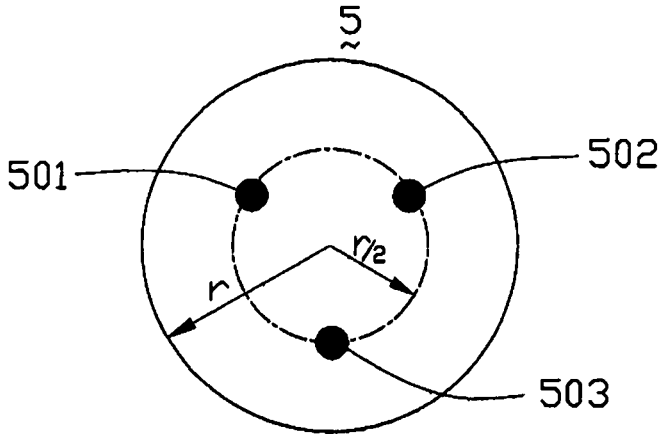
FIG. 3 is a schematic, top elevation of an illuminated pattern device according to a second embodiment of the present invention, showing a distribution of dot light sources thereof.

Referring to FIG. 3, a pattern body of an illuminated pattern device 5 in accordance with the second embodiment of the present invention is circular. A bottom board of the illuminated pattern device 5 has three dot light sources 501, 502, 503 evenly arranged thereon. The dot light sources 501, 502, 503 share a same imaginary circular trace. A center of the circular trace is the same as a center of a projection surface defined on the bottom board. A radius of the projection surface is r, and a radius of the circular trace is r/2.

Figure 4:
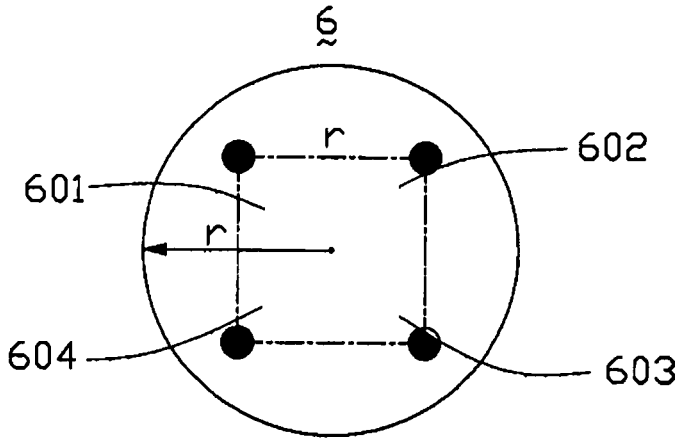
FIG. 4 is a schematic, top elevation of an illuminated pattern device according to a third embodiment of the present invention, showing a distribution of dot light sources thereof.

Referring to FIG. 4, a pattern body of an illuminated pattern device 6 in accordance with the third embodiment of the present invention is circular. A bottom board of the illuminated pattern device 6 has four dot light sources 601, 602, 603, 604 evenly arranged thereon. The dot light sources 601, 602, 603, 604 define an imaginary square. A center of the square is the same as a center of a projection surface defined on the bottom board. A length of each side of the square is the same as a radius of the projection surface.

Figure 5:
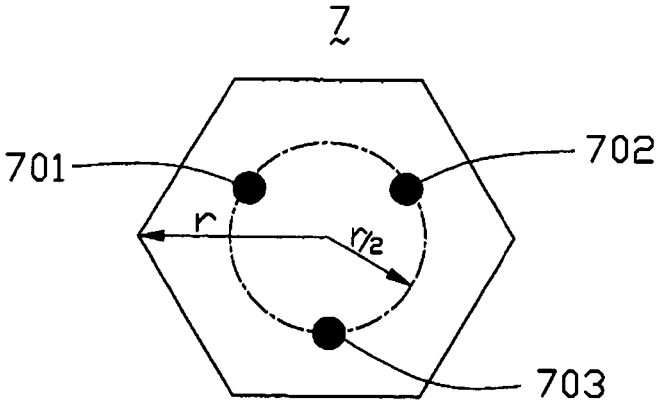
FIG. 5 is a schematic, top elevation of an illuminated pattern device according to a fourth embodiment of the present invention, showing a distribution of dot light sources thereof.
Figure 6:
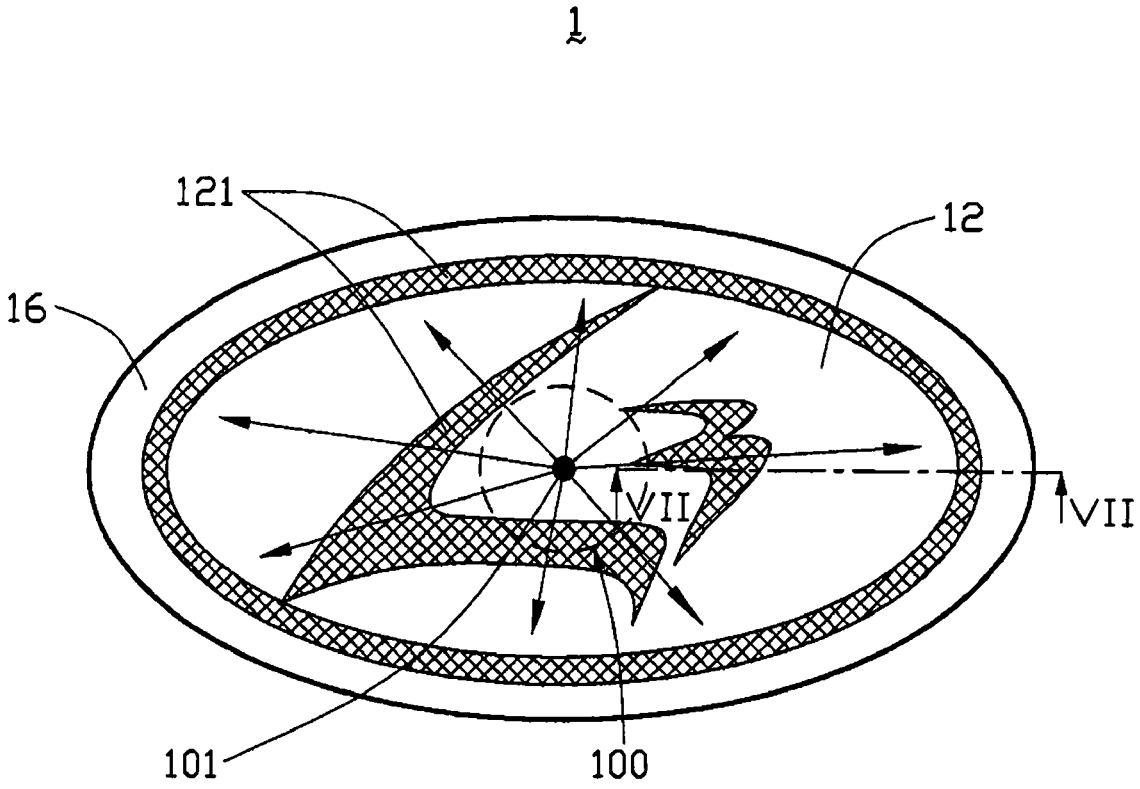
FIG. 6 (PRIOR ART)
FIG. 6 is a schematic, isometric view of a conventional illuminated pattern device, showing light paths thereof.
Figure 7:
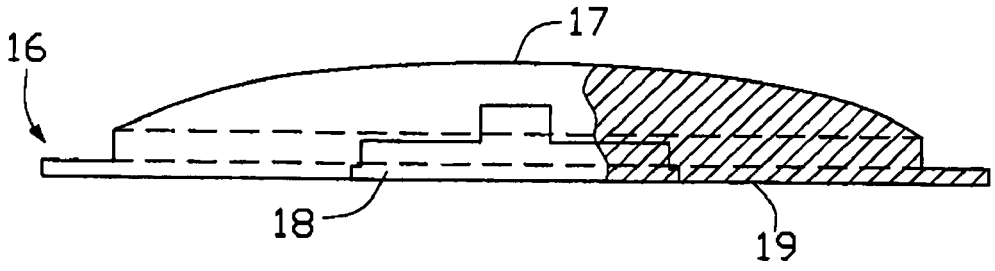
FIG. 7 (PRIOR ART)
FIG. 7 is a schematic, partially side cross-sectional view of the illuminated pattern device of FIG. 6, corresponding to line VII—VII thereof.

Referring to FIG. 5, a pattern body of an illuminated pattern device 7 in accordance with the fourth embodiment of the present invention is hexagonal. A bottom board of the illuminated pattern device 7 has three dot light sources 701, 702, 703 evenly arranged thereon. The dot light sources 701, 702, 703 share a same imaginary circular trace. A center of the circular trace is the same as a center of a projection surface defined on the bottom board. A length of each side of the projection surface is defined as r, and a radius of the circular trace is r/2.

In alternative embodiments, the illuminated pattern device of the present invention can further include a light guide plate arranged between the pattern body and the dot light sources. This provides more uniform light brightness for the illuminated pattern device.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An illuminated pattern device, comprising:

a pattern body having a pattern;

a bottom board disposed opposite to the pattern body, defining a space therebetween; and a plurality of dot light sources arranged on the bottom board and distributed on a designated circular trail, wherein the pattern body defines a projection surface on the bottom board, the dot light sources share a same imaginary circular trace whose center is the same as a center of the projection surface, and a radius of the circular trace is approximately half of a radius of the projection surface.

2. The illuminated pattern device of claim 1, further comprising a light guide plate arranged between the pattern body and the dot light sources.

3. The illuminated pattern device of claim 1, wherein the dot light sources are light-emitting diodes.

4. The illuminated pattern device of claim 1, wherein an unpatterned portion of the pattern body is opaque.

5. The illuminated pattern device of claim 1, wherein an unpatterned portion of the pattern body is translucent.

6. The illuminated pattern device of claim 1, wherein transparent material is filled between the pattern body and the light sources.

7. The illuminated pattern device of claim 1, wherein the pattern body is circular.

8. The illuminated pattern device of claim 7, wherein the illuminated pattern device comprises three dot light sources arranged on the bottom board.

9. The illuminated pattern device of claim 1, wherein the pattern body is hexagonal.

10. The illuminated pattern device of claim 9, wherein the illuminated pattern device comprises three dot light sources arranged on the bottom board.

11. The illuminated pattern device of claim 1 further comprising a frame connecting and sealing the pattern body and the bottom board thereby.

12. The illuminated pattern device of claim 11, wherein the frame has a reflective surface.

13. An illuminated pattern device, comprising:

a circular pattern body having a pattern;

a bottom board disposed opposite to the pattern body, defining a space therebetween; and four dot light sources arranged on the bottom board, the dot light sources defining imaginary square whose center is the same as a center of the projection surface, and a length of each side of the square being approximately the same as a radius of the projection surface.

14. An illuminated pattern device, comprising:

a main body defining a top surface and a bottom surface opposite to the top surface;

a pattern body positioned at the top surface, the pattern body defining a projection surface on the bottom board, the pattern body being elliptical in shape; and two dot light sources arranged on the bottom board, at two focal points of the projection surface.

15. The illuminated pattern device of claim 14, wherein the pattern body comprises a pattern and an unpatterned portion.

16. The illuminated pattern device of claim 14, wherein the main body comprises a frame arranged around the pattern body.

17. The illuminated pattern device of claim 14, wherein the bottom surface is reflective.

* * * * *